US011350723B2

(12) United States Patent
Trochel

(10) Patent No.: US 11,350,723 B2
(45) Date of Patent: Jun. 7, 2022

(54) TUBULAR CARTRIDGE FOR A COSMETIC PRODUCT, CONFIGURED TO BE DETACHABLY COUPLED TO A BASE

(71) Applicant: AXILONE PLASTIQUE, Auray (FR)

(72) Inventor: Reynaid Trochel, Plouharnel (FR)

(73) Assignee: AXILONE PLASTIQUE, Auray (FR)

( * ) Notice: Subject to any disclaimer, the term of this patent is extended or adjusted under 35 U.S.C. 154(b) by 77 days.

(21) Appl. No.: 16/772,347

(22) PCT Filed: Dec. 10, 2018

(86) PCT No.: PCT/FR2018/053168
§ 371 (c)(1),
(2) Date: Jun. 12, 2020

(87) PCT Pub. No.: WO2019/115923
PCT Pub. Date: Jun. 20, 2019

(65) Prior Publication Data

US 2022/0000246 A1 Jan. 6, 2022

(30) Foreign Application Priority Data

Dec. 12, 2017 (FR) ..... 17 62013

(51) Int. Cl.
*B43K 21/08* (2006.01)
*A45D 40/16* (2006.01)
(Continued)

(52) U.S. Cl.
CPC ..... *A45D 40/16* (2013.01); *A45D 40/06* (2013.01); *A45D 2040/0025* (2013.01);
(Continued)

(58) Field of Classification Search
CPC ..... A45D 40/06; A45D 40/16; A45D 2040/0018; A45D 2040/0025; A45D 2040/0037
See application file for complete search history.

(56) References Cited

U.S. PATENT DOCUMENTS 3,623,821 A 11/1971 Gould et al.
4,505,607 A 3/1985 Sugiyama
(Continued)

FOREIGN PATENT DOCUMENTS

CN 203234222 U 10/2013
FR 1118520 A 6/1956
(Continued)

OTHER PUBLICATIONS

International Search Report, dated Mar. 22, 2019, from corresponding PCT application No. PCT/FR2018/053168.
(Continued)

*Primary Examiner* — Jennifer C Chiang
(74) *Attorney, Agent, or Firm* — Nixon & Vanderhye

(57) ABSTRACT

A cartridge for a cosmetic product includes a first longitudinal end for allowing access to the cosmetic product and a second longitudinal end. The cartridge further includes: an outer tube; a control sleeve; a receptacle for cosmetic product; and a bottom element, integral in rotation with the control sleeve. The cartridge is configured so as to be detachably coupled to a base such that a relative rotation of the base in relation to the cartridge causes a movement of the receptacle for cosmetic product. The bottom element contributes to closing off access to the cartridge via the second longitudinal end of the cartridge.

20 Claims, 4 Drawing Sheets

(51) Int. Cl.
*A45D 40/06* (2006.01)
*A45D 40/00* (2006.01)

(52) U.S. Cl.
CPC ..... *A45D 2040/0037* (2013.01); *A45D 2040/0043* (2013.01); *A45D 2040/0056* (2013.01); *A45D 2200/05* (2013.01)

(56) References Cited

U.S. PATENT DOCUMENTS

| | | | | |
|---|---|---|---|---|
| 5,605,408 | A | 2/1997 | Su | |
| 6,116,801 | A | 9/2000 | Patel et al. | |
| 6,293,391 | B1 | 9/2001 | Kim | |
| 8,556,527 | B1 * | 10/2013 | Chou | A45D 40/04 401/98 |
| 10,881,184 | B1 | 1/2021 | Yan | |
| 2010/0078344 | A1 | 4/2010 | Martins et al. | |
| 2013/0022384 | A1 | 1/2013 | Yan | |
| 2017/0196339 | A1 * | 7/2017 | Kim | A45D 40/065 |

FOREIGN PATENT DOCUMENTS

| | | | | |
|---|---|---|---|---|
| FR | 2502471 | A1 | 10/1982 | |
| FR | 2942115 | A1 * | 8/2010 | A45D 40/06 |
| FR | 2942115 | A1 | 8/2010 | |
| GB | 2183220 | A | 6/1987 | |
| JP | S57-155712 | U | 9/1982 | |
| JP | S60173226 | U | 11/1985 | |
| JP | S63-068917 | U | 5/1988 | |
| JP | 2013-517017 | A | 5/2013 | |
| JP | 2013-172888 | A | 9/2013 | |
| KR | 10-2000-0012473 | A | 3/2000 | |
| KR | 10-2004-0034228 | A | 4/2004 | |
| WO | 2011/085511 | A1 | 7/2011 | |
| WO | 2016/011631 | A1 | 1/2016 | |

OTHER PUBLICATIONS

French Search Report, dated Jun. 29, 2018, from corresponding French application No. 1762013.
French Search Report, dated Jun. 26, 2018, from French Application No. 1762012, cited in related U.S. Appl. No. 16/772,088.
French Search Report, dated Jul. 4, 2018, from French Application No. 1762015, cited in related U.S. Appl. No. 16/772,378.
International Search Report, dated Mar. 22, 2019, from PCT Application No. PCT/FR2018/053167, cited in related U.S. Appl. No. 16/772,088.
International Search Report, dated Mar. 29, 2019, from PCT Application No. PCT/FR2018/053169, cited in related U.S. Appl. No. 16/772,378.
Office Action issued in Korean Patent Application No. 10-2020-7019615 dated Aug. 30, 2021.
Office Action issued in Japanese Patent Application No. 2020-531914 dated Oct. 4, 2021.
Office Action issued in the co-pending U.S. Appl. No. 16/772,378 dated Sep. 30, 2021.
Office Action issued in Japanese Patent Application No. 2020-531942 dated Oct. 11, 2021.
Office Action issued in Japanese Patent Application No. 2020-531907 dated Nov. 1, 2021.

* cited by examiner

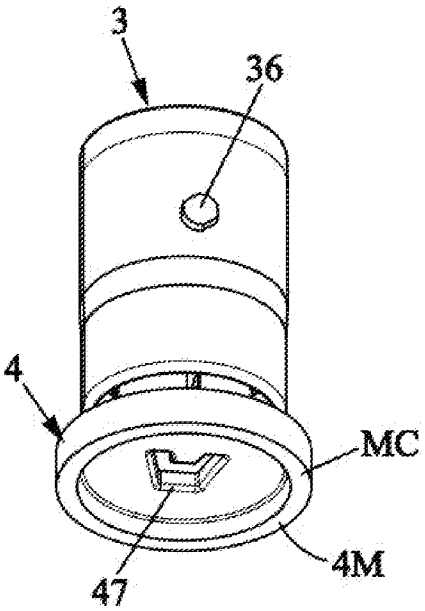
FIG. 10
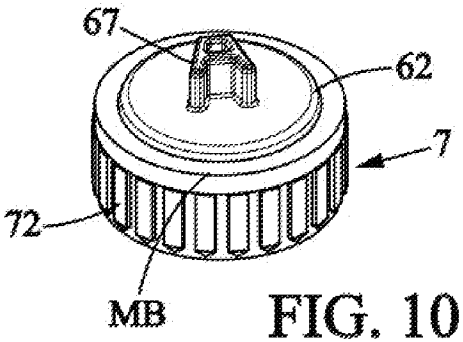
FIG. 9
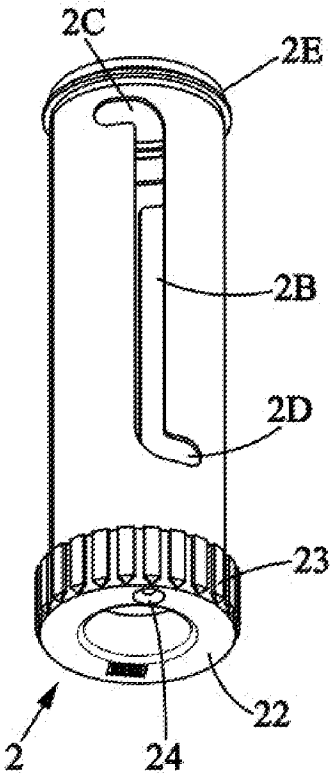
FIG. 8
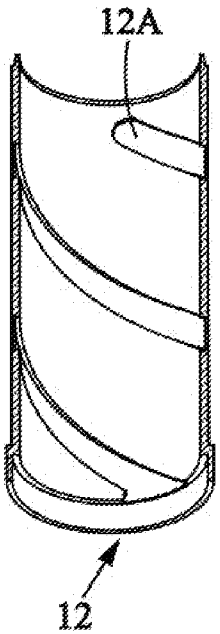
FIG. 7
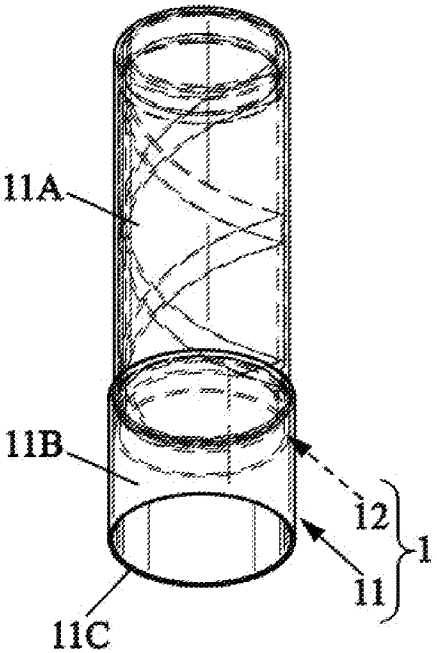

TUBULAR CARTRIDGE FOR A COSMETIC PRODUCT, CONFIGURED TO BE DETACHABLY COUPLED TO A BASE

FIELD OF THE INVENTION

The invention relates to containers for cosmetic products. More specifically, the invention relates to cosmetic product dispensing devices which comprise a base and a cartridge configured to be detachably coupled to each other. The invention relates in particular to lipstick dispensing devices.

TECHNOLOGICAL BACKGROUND OF THE INVENTION

A cosmetic product dispensing device may comprise a base and a cartridge capable of being coupled to the base. This is often the case with lipstick dispensing devices. The cartridge then serves to enclose a stick of lipstick and allow access to it. To achieve this, the cartridge comprises a receptacle for the stick of lipstick. The function of the base is, among other things, to enable gripping the lipstick dispensing device.

The cartridge and the base are arranged in succession along a longitudinal axis of the lipstick dispensing device. In addition, the cartridge and the base are coupled and are rotatable, relative to each other, about an axis of rotation corresponding to the longitudinal axis of the lipstick dispensing device. Thus, by causing a rotation of the base relative to the cartridge, it is possible to move the receptacle for the stick of lipstick along the longitudinal axis of the dispensing device.

Usually, the base and the cartridge are permanently coupled. When the stick of lipstick is consumed, it is therefore necessary to buy a new dispensing device.

To overcome the above disadvantage, dispensing devices have therefore been produced in which the base and the cartridge are detachably coupled. When the stick of lipstick is consumed, it is thus possible to separate the base and the cartridge and to replace only the cartridge, which is more ecological. In addition, a user may possess a single base and several cartridges corresponding to sticks of lipstick of different colors.

However, when the cartridge is not coupled to the base, it is susceptible to contamination by particles. During transport or storage of the cartridge alone, for example in a handbag, particles such as dust or bread crumbs are likely to reach the cartridge. The integrity of the cosmetic product is thus compromised.

OBJECT OF THE INVENTION

An object of the invention is to provide a cosmetic product cartridge which can be detachably coupled to a base and in which the stored cosmetic product is better protected.

BRIEF DESCRIPTION OF THE INVENTION

To achieve this, the invention provides a tubular cartridge for a cosmetic product, comprising a first longitudinal end for allowing access to the cosmetic product and an opposite second longitudinal end in relation to a longitudinal axis, the cartridge further comprising:

- an outer tube comprising at least one helical groove,
- a control sleeve comprising at least one longitudinal guide slot,

- a receptacle for cosmetic product, engaging with the helical groove of the outer tube and the longitudinal guide slot of the control sleeve,
- a bottom element, integral in rotation with the control sleeve, the cartridge being configured so as to be detachably coupled to a base such that a relative rotation of the base in relation to the cartridge causes a movement of the receptacle for cosmetic product in relation to the outer tube along a longitudinal axis of the cartridge, characterized in that the bottom element contributes to closing off access to the cartridge via the second longitudinal end of the cartridge, in that the bottom element comprises a ring of ferromagnetic material or a magnet configured to contribute to providing a retention force between the cartridge and the base when the cartridge is coupled to the base, and in that the bottom element is covered radially outward by the outer tube.

Advantageously, this arrangement makes it possible to protect the cartridge when it is removed from the base and stored, for example in a user's handbag. Here the term 'protect' covers two aspects: the practical impossibility of operating the control sleeve via a rotation of the bottom element when the cartridge is removed from the base, and the prevention of potential contamination of the cartridge by small foreign bodies entering from its second longitudinal end. As the bottom element is covered radially outward by the outer tube, it is not possible to grasp it between two fingers in order to rotate the control sleeve; moreover, given the small diameter of the bottom element, it is very difficult or even impossible to rotate it even by inserting the little finger. Consequently, once the cartridge is removed from the base, the receptacle for cosmetic product remains in its current position and the cosmetic product is perfectly protected against the entry of small foreign bodies into the cartridge. One will note that at the first longitudinal end, in addition to its being closed off by the bottom element, a small plug or a cap may be provided to prevent small foreign bodies from entering the cartridge from the front and contaminating the stick of lipstick.

One will also note that it is not possible to rotate the control sleeve by grasping it.

A single part, namely the bottom element of the cartridge, can thus fulfill two distinct functions. Firstly, the bottom element closes off access to the cartridge and therefore makes it possible, when the cartridge is not coupled to the base, to prevent a user from accessing the cosmetic product or to prevent dust particles from reaching the cartridge when it is for example at the bottom of a handbag. Secondly, the bottom element optionally makes it possible to transmit to the control sleeve a rotational movement produced from the base. It therefore makes it possible to move the cosmetic product receptacle, in particular longitudinally.

Furthermore, one will note that, within the meaning of the invention, "the bottom element contributes to closing off access to the cartridge via the second longitudinal end of the cartridge" means that the bottom element obstructs access along a longitudinal axis of the cartridge. The outer tube can thus surround the bottom element radially and close off radial access to the second longitudinal end of the cartridge. In addition, this means that the bottom element by itself is sufficient to close off access to the cartridge via the second longitudinal end.

In addition, in preferred embodiments of the invention, one or more of the following arrangements may possibly be used:

- The bottom element closes off access to the cartridge via the second longitudinal end of the cartridge; consequently, a single piece, namely the bottom element, makes it possible to close off access to the cartridge;

The bottom element comprises a support portion for a longitudinal end of the control sleeve; the rotational coupling between the bottom element and the control sleeve is thus achieved simply;

An outer radial edge of the bottom element is in direct sliding contact with an inner radial surface of the outer tube; consequently, the arrangement of the bottom element in relation to the outer tube is simpler;

The outer tube extends longitudinally around and along the entire height of the bottom element; thus, when the cartridge is not coupled to the base, the outer tube prevents accidental rotation of the bottom element and therefore accidental movement of the receptacle for cosmetic product;

The outer tube extends substantially along the entire height of the cartridge; consequently, the outer tube forms a protective sheath for the cartridge: it is not possible to grasp the bottom element between two fingers in order to rotate it and the control sleeve;

The bottom element contributes to forming, preferably with the outer tube, the second longitudinal end of the cartridge; the outer tube thus protects the bottom element;

The bottom element is arranged at a distance from and set back from the second longitudinal end of the cartridge; consequently, when the cartridge is not coupled to the base, the bottom element is protected and there is no risk of it accidentally rotating, thereby driving the control sleeve;

The receptacle for cosmetic product comprises at least one guide stud which passes through the longitudinal guide slot of the control sleeve and is arranged in the helical groove of the outer tube; a simple mechanism thus enables movement of the receptacle for cosmetic product along the longitudinal axis of the cartridge;

The guide stud is advantageously a pin; it is therefore easy to obtain by molding;

The bottom element comprises a first face facing the receptacle for cosmetic product and a second longitudinally opposite face, the second face comprising a coupling member configured to engage with the base; as a result, the bottom element integrally secures the base and the control sleeve in rotation about the longitudinal axis of the cartridge;

The bottom element and the sleeve come as one piece; the cartridge thus has fewer separate parts;

The outer tube comprises a covering part which surrounds a technical part comprising a helical groove; consequently, the outer tube comprises two separate parts which each have their own function: the covering part structurally reinforcing the outer tube, the technical part making it possible to implement the mechanism for moving the receptacle along the longitudinal axis of the cartridge;

The cartridge has a first cylindrical portion and a second cylindrical portion arranged following the first cylindrical portion, the second cylindrical portion comprising the bottom element and having a diameter greater than the diameter of the first cylindrical portion; the second cylindrical portion thus has a larger inside space to accommodate a coupling mechanism between the bottom element and the base or between the bottom element and the control sleeve or between the base and the control sleeve;

The cosmetic product is a stick of lipstick;

The bottom element comprises an annular region loaded with ferromagnetic elements; it is thus easy to obtain a magnetic coupling, even without the presence of a permanent magnet in the cartridge, The bottom element has a substantially flat central outer face (in a midplane perpendicular to the X axis, and preferably set slightly back); such that, when the cartridge is in a handbag, the risk of finding foreign objects or bodies trapped on the bottom side of the cartridge is significantly reduced.

Also provided according to the invention is a cosmetic product dispensing device, comprising a cartridge as described above and a base, the cartridge and the base being detachably coupled.

According to one option, a permanent magnet is provided in the base. As the base is a valuable part of the case, it is preserved in the event of a cartridge change and therefore the permanent magnet is not thrown out with the cartridge, instead it is preserved in the base.

According to one option, in a configuration where the cartridge is assembled on the base, an interval representing an air gap (e) which separates the permanent magnet from the ring loaded with ferromagnetic elements is less than 0.5 mm and preferably less 0.2 mm. In addition, the cosmetic product dispensing device preferably comprises a stick of lipstick placed in the receptacle for cosmetic product of the cartridge.

BRIEF DESCRIPTION OF DRAWINGS

We will now describe some embodiments of the invention as non-limiting examples, with the aid of the following figures:

FIG. 7 represents a perspective view of a covering part for an outer tube of the cartridges according to a third embodiment, FIG. 8 represents a sectional view of a technical part for the outer tube, FIG. 9 represents a perspective view of a control sleeve for the cartridge according to the third embodiment of the invention, and FIG. 10 illustrates a perspective view of a receptacle for cosmetic product, a bottom element, and the base, without a protective shell, for the dispensing device of the third embodiment.

DETAILED DESCRIPTION OF TWO EMBODIMENTS OF THE INVENTION

For clarity, only the elements useful in understanding the described embodiments have been shown and will be detailed.

It should be noted that in the figures, structural and/or functional elements common to the different embodiments have the same references. Thus, unless otherwise stated, such elements have identical structural, dimensional, and material properties. The scales of representation may vary from one figure to another.

Figure 1:
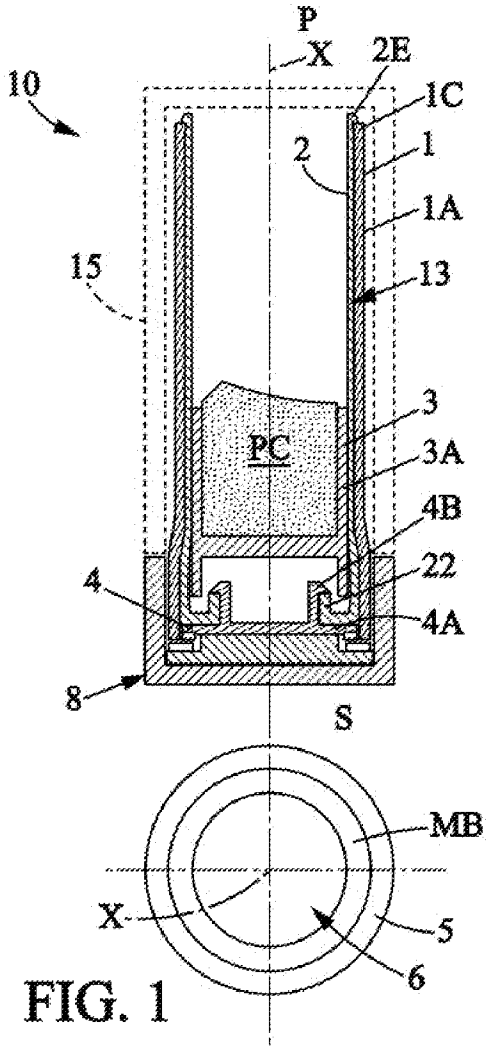
FIG. 1 illustrates a sectional view of a dispensing device in a plane comprising a longitudinal axis, according to one embodiment of the invention which comprises a cartridge, a base, and a cap, and also represents the base in a top view.
Figure 2:
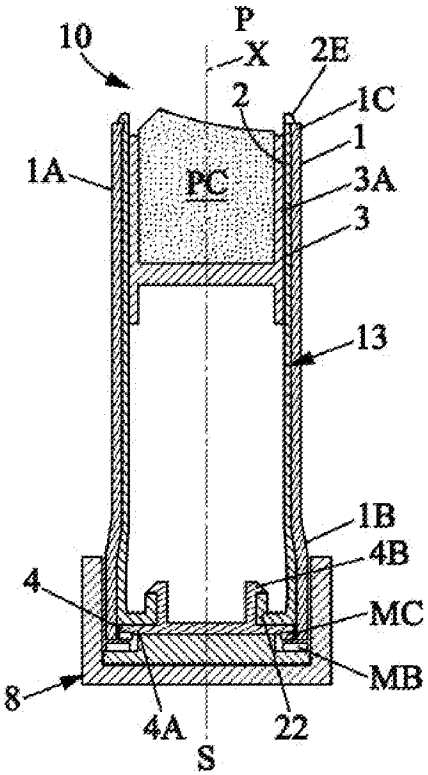
FIG. 2 illustrates this device in the same sectional plane, in which the receptacle for cosmetic product is in the raised position.
Figure 3:
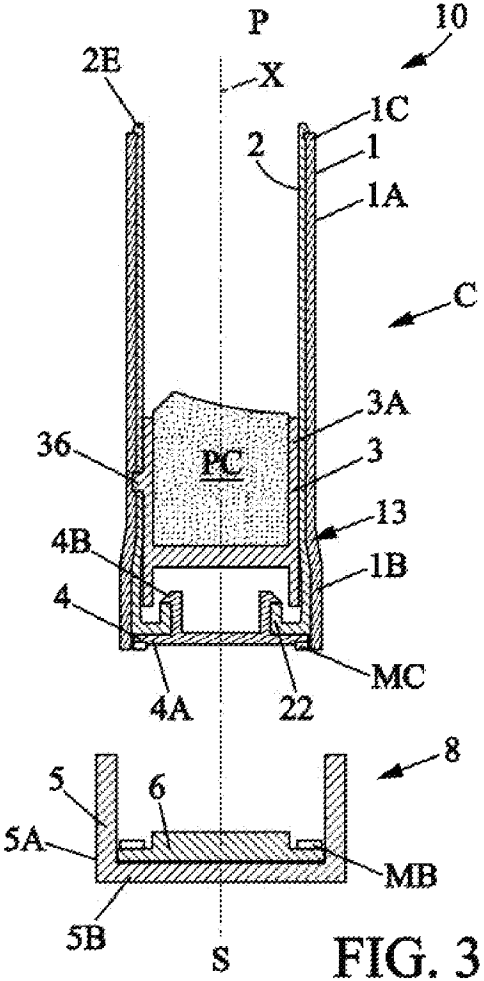
FIG. 3 represents the uncoupled base and cartridge, again in the sectional plane described above.
Figure 5:
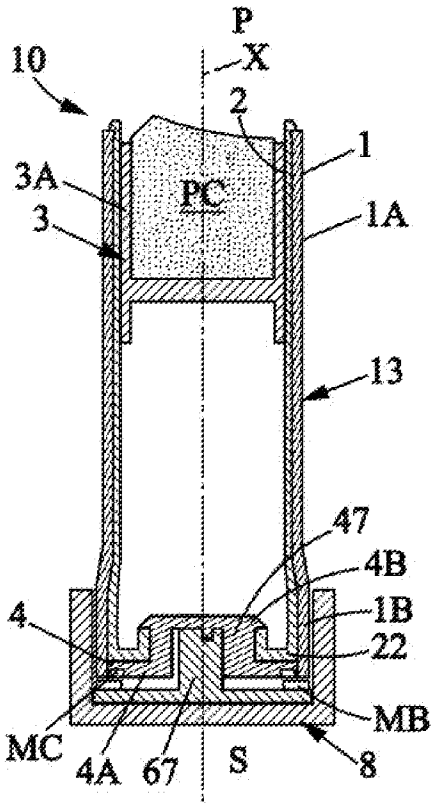
FIGS. 4 to 6 are respective views similar to FIGS. 1 to 3, of a dispensing device according to a second embodiment.
Figure 4:
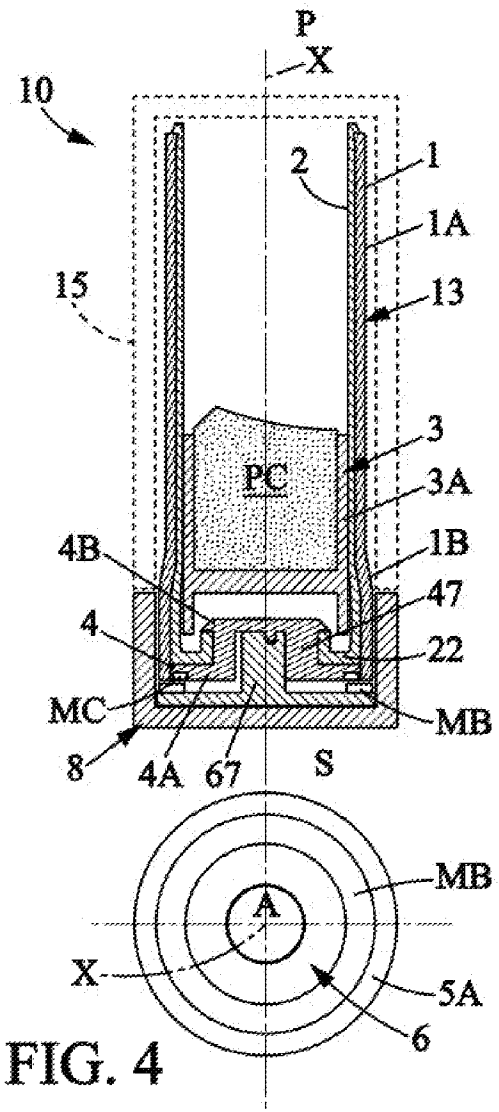
Figure 11:
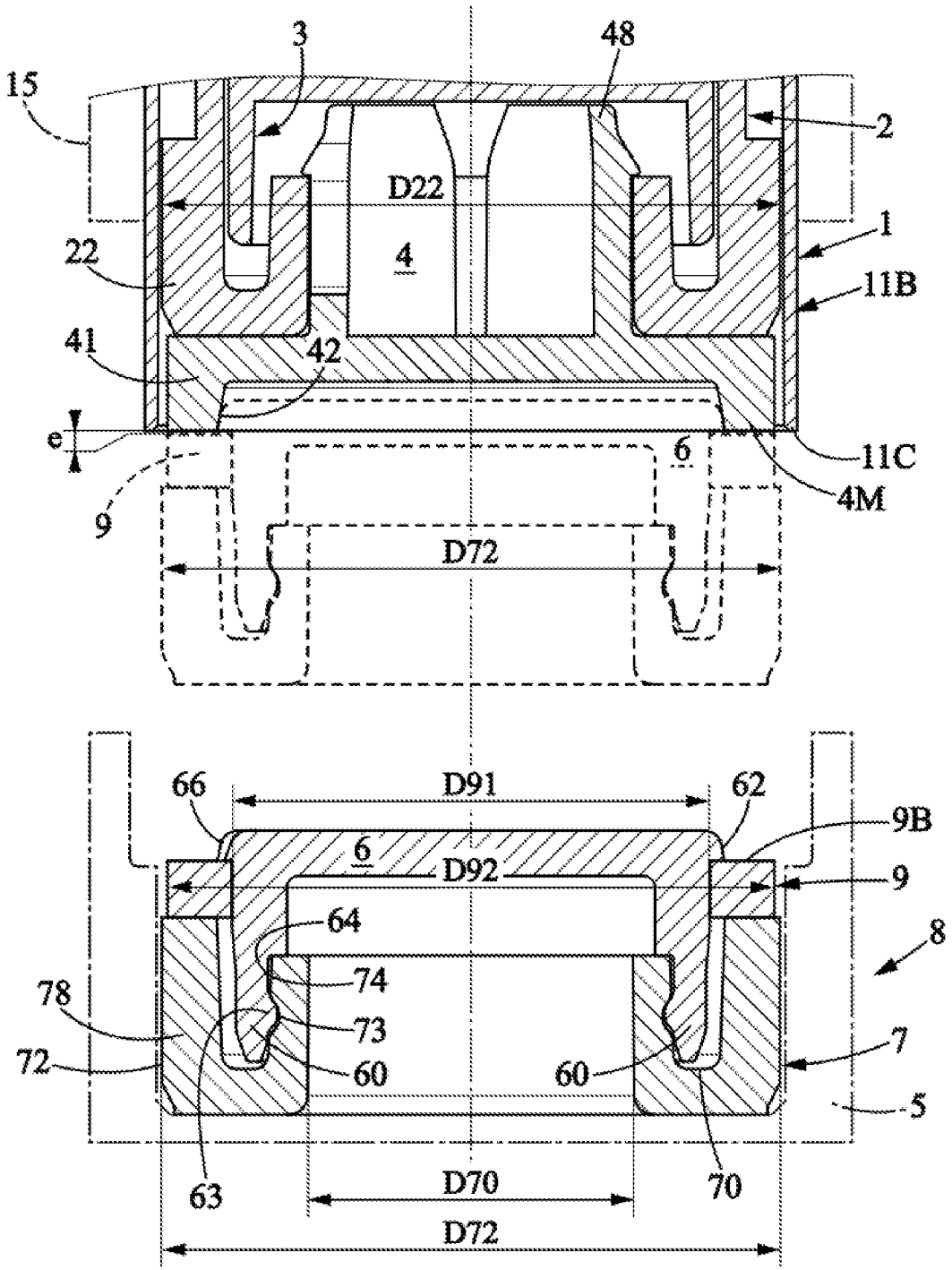
FIG. 11 illustrates more particularly the magnetic retention interface between the base and the cartridge, according to a variant of the third embodiment.

A cosmetic product dispensing device 10 according to the invention comprises a base 8, a cartridge 13, and optionally a cap 15 represented with phantom lines in FIGS. 1 and 4. The dispensing device 10 is represented with the aid of schematic diagrams, according to a first embodiment of the invention in FIGS. 1 to 3 and according to a second embodiment of the invention in FIGS. 4 to 6. FIGS. 7 to 10 relate to a third embodiment. FIG. 11 relates to a variant of the third embodiment.

The base 8 and the cap 15 together form a decorative setting provided to enhance the cosmetic product dispensing device. The base and the cap may in particular have a highly aesthetic decoration, or even a decoration providing luxury customization.

The cartridge 13 comprises an outer tube 1, a control sleeve 2, a receptacle 3 for the stick of lipstick PC, and a bottom element 4 as will be described in more detail below.

In the embodiments described, the dispensing device 10 is a lipstick case. It thus contains a stick of lipstick PC. The stick of lipstick PC is in the form of a solid or semi-solid material, in particular pasty, and is applied by rubbing it on the lips of a user.

In addition, the dispensing device 10 has a generally cylindrical shape and has a longitudinal axis X. It extends between a first longitudinal end P and a second longitudinal end S. The second longitudinal end S of the dispensing device 10 is the one furthest from the user's lips when the user is applying the stick PC to the lips. In the following description, reference will also be made to first P and second S longitudinal ends, defined as above, when describing members of the dispensing device 10. In addition, the adjectives "inner" and "outer" will be used in relation to the interior and exterior respectively of the dispensing device 10. In addition, a midplane is defined as being a plane perpendicular to the longitudinal axis X.

The dispensing device 10 is able to be in a closed position, illustrated in FIGS. 1 and 4, in which the cap 15 is closing off access from a first longitudinal end P to the interior of the cartridge 13. The dispensing device 10 is also able to be in an open position, illustrated in FIGS. 2, 3 and 5, 6, in which the interior of the cartridge 13 is accessible from the first longitudinal end P.

One will note that the base 8 and the cap 15 are configured to cooperate, for example by magnetic or mechanical means, so that when the dispensing device 10 is in the closed position, the cartridge 13 is hidden from the exterior of the dispensing device 10, by the base 8 and cap 15.

Furthermore, the base 8 and the cartridge 13 can be detachably coupled as will be described in more detail below. The base 8 and the cartridge 13 are coupled in FIGS. 1, 2 and 4, 5. They are shown uncoupled in FIGS. 3 and 6.

For example, the user may wish to buy a replacement cartridge 13 when the stick of lipstick PC has been consumed. The user may also wish to keep, for example in a handbag, several cartridges 13 each containing a stick of lipstick PC of a different color. The user may also wish to use a specific base 8 and cap 15 to enclose the cartridge 13 in a certain situation, for example in a business setting, and use another base 8/cap 15 assembly to enclose the cartridge 13 in another situation, for example in a party setting. The cartridge 13 may thus often be uncoupled from the base 8, sometimes for a long period. There is therefore a risk of dust entering the cartridge 13 and contaminating the stick of lipstick PC.

The base 8 has a generally cylindrical shape and comprises a protective shell 5 which forms an outer wall of the base 8. The protective shell 5 comprises a cylindrical wall 5A which extends along the longitudinal axis X. In addition, the protective shell 5 comprises a flat wall 5B which extends in a plane perpendicular to the longitudinal axis X. The flat wall 5B forms a bottom of the protective shell 5. The flat wall 5B thus forms a second longitudinal end S of both the protective shell 5 and the base 8.

In addition, the base 8 comprises a coupling element 6 resting on a face of the flat wall 5B facing the bottom element 4 when the base 8 and the cartridge 13 are detachably coupled. The coupling element 6 has the function of making it possible to detachably couple the base 8 to the cartridge 13 as will be described in detail below.

The base 8 may in particular be made of injected plastic. The protective shell 5 and the coupling element 6 may come as one piece or be formed separately and assembled by gluing for example. The protective shell 5 and the coupling element 6 are integral in rotation. In addition, the base 8 may have a circular, square, or even hexagonal cross-section.

According to the first embodiment, the coupling element 6 comprises a flat disc, further extending in the midplane, which circumferentially carries a permanently magnetized element which here is in the form of a magnet MB. The magnet MB has a general ring shape and extends circumferentially around the longitudinal axis X on a radial peripheral edge of the coupling member 6. The flat disc thus has a circumferential recess for carrying the magnet MB so that an upper surface of the flat disc and the magnet MB are arranged at substantially the same height along the longitudinal axis X. In this embodiment, the magnet MB essentially comprises iron, in particular in the form of ferrite, for example strontium ferrite or barium ferrite. In some variants, the magnet MB comprises an alloy of neodymium, iron, and boron, or an alloy of aluminum, nickel, and cobalt, or a polymer material which contains a powder comprising one of the materials or alloys described above.

In FIG. 11, the magnet MB is an annular magnet denoted 9 held in place by snap-fitting two plastic parts 6,72.

In a typical example, the outside diameter D92 of the annular magnet MB is 16 mm. In a typical example, the inside diameter D91 of the annular magnet MB is 12 mm.

The axial thickness of the annular magnet 9 is between 1 mm and 2 mm.

According to the second embodiment, the coupling element 6 comprises a member 67 in the shape of a key, visible in particular in FIG. 10.

One will note that in this figure, the base 8 is presented in a slight variant. The coupling element 6 has a cylindrical skirt, which extends longitudinally towards the second longitudinal end S from the magnet MB. The cylindrical skirt carries rotation-coupling grooves 72 in order to, if necessary, secure the protective shell 5 and the coupling member 6 to be integral in rotation.

In the bases 8 of FIGS. 1 to 6, the protective shell 5 and the coupling element 6 are integral because these two elements are one piece. They may also be glued.

As indicated above, the cartridge 13 comprises the outer tube 1, the control sleeve 2, the receptacle 3 for the stick of lipstick PC, and the bottom element 4.

The outer tube 1, also illustrated in FIGS. 7 and 8, has the function of forming an outer cylindrical wall for the cartridge 13. The outer tube 1 thus has a generally cylindrical shape of axis X. It has a first longitudinal end P intended to allow access to the stick of lipstick PC and an opposite second longitudinal end S. The first longitudinal end P of the outer tube 1 also forms a first longitudinal end P for the cartridge 13. In addition, the outer tube 1 extends substantially along the entire height of the cartridge 13. It thus forms a protective sheath for the cartridge 13.

As illustrated in FIGS. 7 and 8, the outer tube 1 comprises a covering part 11 which surrounds a technical part 12. The covering part 11 gives the outer tube 1 adequate structural reinforcement. The technical part 12 comprises, on an inner cylindrical face, two helical grooves 12A which extend along the longitudinal axis X of the cartridge 13. These two helical grooves 12A are arranged opposite one another.

In addition, the outer tube 1 has a first cylindrical portion 1A and a second cylindrical portion 1B arranged following the first cylindrical portion 1A. The first cylindrical portion 1A is closer to the first longitudinal end P of the cartridge 13 than the second cylindrical portion 1B. The second cylindrical portion 1B has a diameter greater than the diameter of the first cylindrical portion 1A, for example 17 mm and 16 mm respectively for the outside diameters.

Thus, the cartridge 13 also has a first cylindrical portion and a second cylindrical portion arranged following the first cylindrical portion. The second cylindrical portion has a diameter greater than the diameter of the first cylindrical portion.

Similarly, the covering part 11 has a first cylindrical portion 11A and a second cylindrical portion 11B arranged following the first cylindrical portion 11A. The first cylindrical portion 11A is closer to the first longitudinal end P of the outer tube 1 than the second cylindrical portion 11B. The second cylindrical portion 11B has a diameter greater than the diameter of the first cylindrical portion 11A.

One will note that the lower edge 110 of the outer tube forms an integral radial protection for the bottom element (skirt function) as well as for the control sleeve (2,22). In other words, the bottom edge 11C extends down to the bottom and forms the overall lengthwise dimension of the cartridge.

For the assembly, the technical part 12 is inserted into the covering part 11 from below, until it abuts against the inside shoulder (see FIG. 7).

The covering part 11 and the technical part 12 may be formed of metal or injected plastic. They may be fixed to each other by gluing. The covering part 11 and the technical part 12 may also come as one piece.

In addition, the outer tube 1 comprises, at its first longitudinal end P, a circumferential coupling edge 1C whose function will be described below.

The control sleeve 2 also has a generally cylindrical shape. It is arranged against the inner cylindrical walls of the outer tube 1. As illustrated in FIG. 11, the control sleeve 2 comprises a main body 2A of regular generally cylindrical shape. On this main body 2A, the control sleeve 2 comprises two longitudinal guide slots 2B that are diametrically opposite through-slots. Each longitudinal guide slot 2B extends parallel to the longitudinal axis X. At its first P and second S longitudinal ends, each longitudinal guide slot 2B extends perpendicularly to the axis (X) for a small distance relative to its longitudinal dimension, so as to define two end-of-travel positions 2C, 2D for the receptacle 3 as will be described below. End-of-travel position 2C is relatively closer to the first longitudinal end P of the cartridge 13 than end-of-travel position 2D.

In addition, on the radial periphery of its first longitudinal end P, the main body 2A comprises a flange 2E. The function of the 2E flange will be described below.

In addition, the control sleeve 2 comprises a coupling member 22 arranged following the main body 2A, forming a second longitudinal end S of the control sleeve 2.

One will note that the coupling member 22 can be used to couple the control sleeve 2 to a base for a dispensing device in which the base and the cartridge are non-detachably coupled. To do this, the coupling member 22 comprises a cylindrical wall comprising a plurality of coupling grooves 23.

In addition, the coupling member 22 comprises an orifice 24, on a wall facing the base when the base and the cartridge are coupled, due to the fact that the control sleeve 2 is preferably formed by injection of a plastic material.

In the case of the present invention, the outer tube 1 and in particular the second cylindrical portion 11B of the covering part 11 surrounds this coupling member 22. Thus, advantageously, the dispensing device 10 according to the invention can be implemented with a control sleeve 2 that is also suitable for a dispensing device 10 in which the base and the cartridge are non-detachably coupled. In addition, the coupling member also serves to couple the control sleeve 2 to the bottom element 4.

The receptacle 3 for the stick of lipstick PC here is in the form of a receiving cup. In addition, it comprises a main body 3A of regular generally cylindrical shape, in other words of constant diameter along the longitudinal axis X. As illustrated in FIG. 10, the receptacle 3 comprises, on an outer face of the main body 3A, two guide studs 36 which are diametrically opposite and which extend radially outward from the receptacle 3. The function of the two guide studs 36 will be described below. The receptacle 3 also preferably comprises injected plastic.

The bottom element 4 occupies the second longitudinal end S of the cartridge 13. In addition, the bottom element 4 comprises first means for coupling to the base 8. The bottom element 4 also comprises second means for coupling to the control sleeve 2 so that the bottom element 4 and the control sleeve 2 are integral in rotation.

According to the embodiments shown, the first means for coupling to the base 8 comprise a radial peripheral rim 4M of the bottom element 4.

In the examples illustrated in FIGS. 7 to 11, the radial peripheral rim 4M forms a magnetic coupling/retention means and for this purpose is loaded with ferrites, in other words more generally a ferromagnetic material capable of being magnetized in an induced manner under the effect of an incident magnetic field.

More specifically, the ferromagnetic material is a material having a passive magnetic property, in other words a material which does not induce a permanent magnetic field under normal conditions but which is attracted by a magnet.

For example, particles of such a ferromagnetic material may be inserted into the plastic substrate to be molded.

For example, the plastic substrate to be molded is a thermoplastic material, such as polypropylene (PP), polyethylene terephthalate (PET), polyvinyl chloride (PVC), or any other polymer suitable for molding and/or injection. The passive magnetic particles may be, for example, iron particles, ferrite particles, or passivated ferric oxide particles.

According to an alternative solution illustrated in FIGS. 1 to 6, the bottom element 4 may comprise a permanently magnetized element which here is in the form of a magnet MC. The magnet MC has a general ring shape and extends circumferentially around the longitudinal axis X on a radial peripheral rim of the bottom element 4.

In one embodiment, the magnet MC essentially comprises iron, particularly in the form of ferrite, for example strontium ferrite or barium ferrite. According to some variants, the magnet MC comprises an alloy of neodymium, iron, and boron, or an alloy of aluminum, nickel, and cobalt, or a polymer material which contains a powder comprising one of the materials or alloys described above. According to some variants, the magnet MC may be a part of ferromagnetic material which is magnetized by an incident magnetic field.

The magnet or ring made of ferromagnetic material MC is arranged on a face of the bottom element 4 facing the flat wall 5B of the base 8 when the base 8 and the cartridge 13 are coupled.

At this location, the air gap in the coupled position will be less than 0.5 mm and preferably less than 0.2 mm. Knowing that the force of attraction between two elements under the action of a magnetic field decreases with the cube of the air gap distance, we will seek to obtain as small a space as possible and in practice we will seek to have the ring of ferromagnetic material NC directly in contact with the magnet 9, as shown in phantom lines in FIG. 11.

According to the second embodiment of the invention, the first means for coupling to the base 8 comprise a coupling member 4B having a portion 47 in the form of a lock as illustrated in FIG. 10.

According to some embodiments of the invention, the second means for coupling to the control sleeve 2 comprise a support portion 4A which extends in the midplane and which supports the coupling member 22 which thus forms a second longitudinal end S of the control sleeve 2. This support portion 4A is circumferential.

According to the first embodiment, the second means for coupling to the control sleeve 2 comprise at least one tongue 4C cooperating with at least one complementary member, for example a tongue, of the coupling member 22 of the control sleeve 2.

According to the second embodiment, the second means for coupling to the control sleeve 2 comprise a member 4D having a shape close to that of the tongue 4C, and which also cooperates with at least one member having a shape complementary to the coupling member 22 of the control sleeve 2.

These second means for coupling are carried by a face axially opposite the receptacle 3.

In addition, the bottom element 4 closes off access to the interior of the cartridge 13 via the second longitudinal end S of the cartridge 13. It thus forms a bottom of the cartridge 13. According to one variant, the bottom element 4 contributes to closing off access to the interior of the cartridge 13, for example by engaging with a flanged edge of the outer tube 1 which extends in the midplane.

Thus, even when the cartridge 13 is uncoupled from the base 8, the stick of lipstick PC is protected from particles which could enter the cartridge 13 via the second longitudinal end S of the cartridge 13.

Note that the central portion 4A of the bottom element illustrated in FIG. 11 is essentially a flat disc 41 of small thickness. In addition, extending upwards from the flat disc, there are snap-fitting tabs 48 for the attachment to the control sleeve 2 (in particular to the coupling member 22).

In the various embodiments, the outer tube 1 radially surrounds and extends longitudinally over the entire height of the bottom element 4. In the current case, the second cylindrical portion of the cartridge 13 comprises the bottom element 4. In addition, a radial edge of the bottom element 4 is in direct contact with a radially inner face of the outer tube 1. Thus, as can be seen in particular in FIGS. 1 to 6, the bottom element 4 forms, with the outer tube 1, the second longitudinal end S of the cartridge 13.

One will note that according to an advantageous variant, the bottom element 4 is arranged at a distance from and set back from the second longitudinal end S of the cartridge 13.

We will now describe more precisely a detachable coupling between the base 8 and the cartridge 13.

According to the first and second embodiments, the magnet MB of the base 8 and the magnet MC of the bottom element 4 are arranged facing one another when the base 8 and the cartridge 13 are detachably coupled. In addition, their facing sides have opposite polarities. They thus cooperate and generate a force that detachably couples the base 8 and the cartridge 13. According to the first embodiment, this coupling force is sufficient to secure the base 8 and the bottom element 4 such that they are integral in rotation about the longitudinal axis X.

According to the second embodiment, the key-shaped member 67 of the coupling element 6 of the base 8 engages with the coupling member 4B having the lock-shaped portion 47 of the bottom element 4. This engagement also contributes to securing the base 8 and the bottom element 4 so that they are integral in rotation about the longitudinal axis X.

One will note that the respective key and lock shapes of the coupling element 6 of the base 8 and of the coupling member 4B of the bottom element 4 may be of any type. For example, these shapes may represent an "A" as illustrated in FIG. 12, an "X", a "C", or even an "O".

According to a variant third embodiment, with particular reference to FIG. 11, the magnetic and mechanical interface between the base and the cartridge is shown in more detail in an uncoupled configuration (solid lines) and in a coupled configuration (dotted lines). The coupling element 6 is associated with a base element 7 in order to attach a permanent magnet 9 by snap-fitting. The base element 7 comprises an annular groove 70 which opens upwards and is designed to receive snap-fitting tabs 60 projecting downwards from the coupling element 6. The base element 7 may be glued or fixed in the protective shell 5. The outer rim 78 of the base element comprises ribs 72 engaged in the protective shell 5 in order to integrally secure it at least in rotation.

The snap-fitting tabs 60 comprise a bead 63 and an annular groove 64. The bead 63 is received in a complementary annular groove 73 of the base element 7. The annular groove 64 receives a complementary bead 74 of the base element 7. This forms a solid and durable snap-fit. Advantageously, a reliable and durable assembly is thus formed without the use of glue.

In addition, an upper annular edge 62 is provided which forms a shoulder to hold the element 9 in position against the outer rim 78 of the base element 7. The upper annular edge 62 may be continuous or discontinuous in the circumferential direction.

The outside diameter D72 of the base element is preferably within the range of values [15 mm-17 mm]. One will note that this diameter D72 is preferably advantageously identical to the diameter D22 of the coupling member of the control sleeve, which makes it possible to optimize the assembly means.

The inside diameter D70 of the base element is preferably within the range of values [8 mm-12 mm].

If we consider the air gap denoted e which separates the upper surface 9B of the permanent magnet and the lower surface of the ferrite ring 4B of the bottom element, in the coupled configuration this is preferably less than 0.5 mm, or even close to zero.

In the example of FIG. 11, the rotational driving of the bottom element 4 by the coupling element 6 is obtained in the peripheral region by means of striations 66 which in the coupled position are received in complementary striations 42 of the bottom element 4. Another solution consists of providing a sufficient area of friction in the area of contact of the magnetic means (magnet MB versus ferrite ring 4B).

We will now describe an operation of the dispensing device 10, in particular to access the stick of lipstick PC. Thus, below we will describe the movements of the members of the cartridge 13 in relation to each other.

The flange 2E of the control sleeve 2 has the function of engaging with the circumferential coupling edge 10 of the outer tube 1 as illustrated in FIGS. 1 to 6, in particular in order to lock the control sleeve 2 in translation along the longitudinal axis X relative to the outer tube 1. In addition, the control sleeve 2 is rotatable about the longitudinal axis X relative to the outer tube 1.

The bottom element 4 is integral in rotation about the longitudinal axis X in relation to the control sleeve 2. Thus, when the base 8 and the cartridge 13 are detachably coupled, the base 8 and the control sleeve 2 are integral in rotation about the longitudinal axis X.

In addition, the receptacle 3 engages with the helical groove 12A of the outer tube 1 and the longitudinal guide slot 2B of the control sleeve 2. To achieve this, each of the two guide studs 36 of the receptacle 3 engages with one of the two longitudinal guide slots 2B of the control sleeve 2 and traverses said slot. The receptacle 3 is thus movable in longitudinal translation relative to the control sleeve 2, between the two end-of-travel positions 2C and 2D for the guide stud 36. In addition, each guide stud 36 engages with one of the two helical grooves 12A of the outer tube 1 when arranged within said groove. The receptacle 3 is thus movable in rotation about the longitudinal axis X and in longitudinal translation relative to the outer tube 1.

When the control sleeve 2 begins to rotate relative to the outer tube 1 in relation to the longitudinal axis X, each guide stud 36 of the receptacle 3 thus moves along a helical groove 12A and a longitudinal groove 2B. The receptacle 3 thus begins to rotate about the longitudinal axis X and to move in longitudinal translation relative to the outer tube 1.

Thus, when the user wishes to move the receptacle 3 longitudinally relative to the outer tube 1, for example to cause the stick of lipstick PC to project beyond the first longitudinal end P of the outer tube 1, he or she locks the outer tube 1 against longitudinal translation and rotation about the longitudinal axis X. Next, he or she imparts a rotational movement to the protective shell 5 of the base 8, about the longitudinal axis X relative to the outer tube 1. The bottom element 4 and the control sleeve 2 thus begin to rotate about the longitudinal axis X relative to the outer tube 1. Each guide stud 36 of the receptacle 3 will then move along a helical groove 12A and a longitudinal guide slot 2B. The receptacle 3 thus moves longitudinally along the cartridge 13. It can therefore be seen that a relative rotation of the base 8 in relation to the cartridge 13 causes the receptacle 3 for the stick of lipstick PC to move in relation to the outer tube 1 along the longitudinal axis X of the cartridge 13.

Of course, many variations can be applied to the invention without departing from the scope thereof.

The bottom element 4 and the control sleeve 2 in particular may come as one piece.

Figure 6:
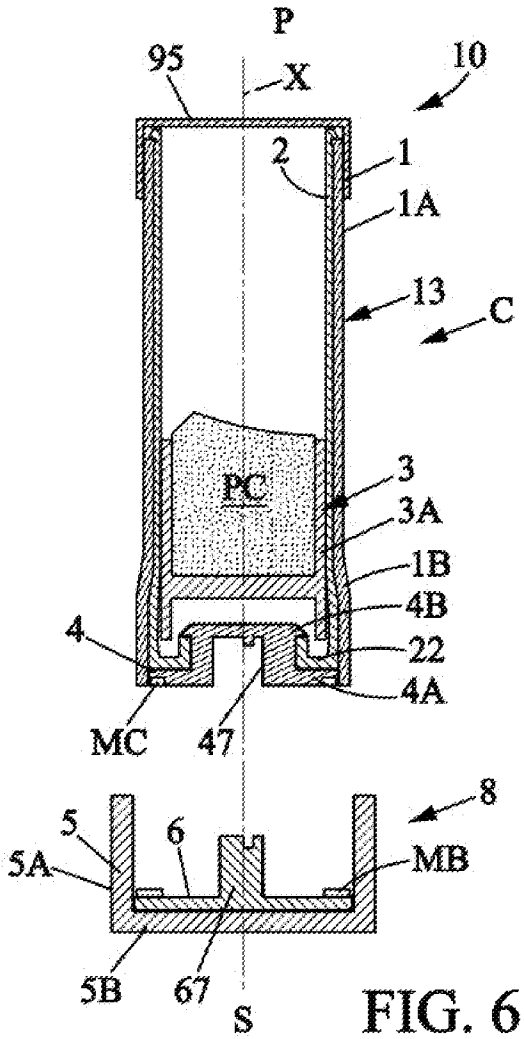

Advantageously, as illustrated in FIG. 6, a small plug 95 or a cap is provided to prevent small foreign bodies from entering the cartridge from the front and contaminating the stick of lipstick.

The invention claimed is:

1. Tubular cartridge (13) for a cosmetic product (PC), comprising a first longitudinal end (P) intended to allow access to the cosmetic product (PC) and an opposite second longitudinal end (S) in relation to a longitudinal axis (X), the cartridge (13) further comprising:

an outer tube (1) comprising at least one helical groove (12A), a control sleeve (2) comprising at least one longitudinal guide slot (2B), a receptacle (3) for cosmetic product (PC), engaging with the helical groove (12A) of the outer tube (1) and the longitudinal guide slot (2B) of the control sleeve (2), a bottom element (4), integral in rotation with the control sleeve (2), the cartridge (13) being configured so as to be detachably coupled to a base (8) such that a relative rotation of the base (8) in relation to the cartridge (13) causes a movement of the receptacle (3) for cosmetic product (PC) in relation to the outer tube (1) along a longitudinal axis (X) of the cartridge (13), wherein the bottom element (4) contributes to closing off access to the cartridge (13) via the second longitudinal end (S) of the cartridge (13), wherein the bottom element (4) comprises a ring of ferromagnetic material or a magnet (4B, MB) configured to contribute to providing a retention force between the cartridge and the base when the cartridge is coupled to the base, and wherein the bottom element (4) is covered radially outward by the outer tube (1).

2. The cartridge (13) according to claim 1, wherein the bottom element (4) closes off access to the cartridge (13) via the second longitudinal end (S) of the cartridge (13).

3. The cartridge (13) according to claim 1, wherein an outer radial edge of the bottom element (4) is in direct sliding contact with an inner radial surface of the outer tube (1).

4. The cartridge (13) according to claim 1, wherein the outer tube (1) extends substantially along the entire height of the cartridge (13).

5. The cartridge (13) according to claim 1, wherein the bottom element (4) is arranged at a distance from and set back from the second longitudinal end (S) of the cartridge (13).

6. The cartridge (13) according to claim 1, wherein the bottom element (4) comprises a first face facing the receptacle (3) for cosmetic product (PC) and a second longitudinally opposite face, the second face comprising a coupling member (MC, 4B, 47) configured to engage with the base (8).

7. The cartridge (13) according to claim 1, wherein the coupling member (MC, 4B, 47) comprises a three-dimensional coded pattern (47) configured to engage with an operating member (6) of the base (8), the operating member (6) comprising a counterpart three-dimensional coded pattern.

8. The cartridge (13) according to claim 7, wherein the three-dimensional coded pattern (67) and the counterpart three-dimensional coded pattern (47) are each circumscribed within a cylinder having a diameter (D6) of less than 8 mm.

9. The cartridge (13) of claim 8, wherein the cylinder has a diameter of less than 7 mm.

10. The cartridge (13) of claim 8, wherein the cylinder has a diameter of less than 6 mm.

11. The cartridge (13) according to claim 7, wherein the three-dimensional coded pattern (67) forms a male part and the counterpart three-dimensional coded pattern (47) forms a female part.

12. The cartridge (13) according to claim 11, wherein the three-dimensional coded pattern of the operating member (6) has a key shape (67), and the counterpart three-dimensional coded pattern of the operating counterpart (4A) has a lock shape (47).

13. The cartridge (13) according to claim 1, wherein the cosmetic product (PC) is a stick of lipstick.

14. The cartridge (13) according to claim 1, wherein the bottom element (4) has a substantially flat central outer face.

15. Dispensing device (10) for a cosmetic product (PC), comprising a cartridge (13) according to claim 1 and a base (8), the cartridge (13) and the base (8) being detachably coupled.

16. The dispensing device (10) according to claim 15, wherein there is provided in the base (8) a permanent magnet (9, MB) or a ring of ferromagnetic material associated with the ring of ferromagnetic material or the magnet (4B, MB) of the associated base element (4) in order to contribute to providing a retention force between the cartridge and the base when the cartridge is coupled to the base.

17. The dispensing device (10) according to claim 16, wherein, in a configuration where the cartridge is assembled on the base, an interval representing an air gap (e) which separates an upper surface (9B) of the permanent magnet (9, MB) or of the ring of ferromagnetic material of the base (8) and a lower surface of the ring of ferromagnetic material (4M) or magnet of the associated base element (4) is less than 0.5 mm.

18. The dispensing device of claim 17, wherein the air gap is less than 0.2 mm.

19. The dispensing device of claim 15, further comprising a stick of lipstick.

20. The dispensing device for a cosmetic product (PC), comprising a cartridge (13) according to claim 1 and a base (8), the cartridge (13) and the base (8) being detachably coupled, wherein the bottom element (4) comprises a first face facing the receptacle (3) for cosmetic product (PC) and a second longitudinally opposite face, the second face comprising a coupling member (MC, 4B, 47) configured to engage with the base (8), wherein the operating member (6) of the base (8) is able to be coupled with the coupling member (MC, 4B, 47) of the bottom element (4) so that a relative rotation of the base (8) in relation to the cartridge (13) causes a movement of the receptacle (3) of cosmetic product (PC) along a longitudinal axis (X) of the cartridge (13).

* * * * *